United States Patent [19]

Carnaby

[11] 4,274,346

[45] Jun. 23, 1981

[54] CUT PILE LOOPER

[75] Inventor: Garth A. Carnaby, Christchurch, New Zealand

[73] Assignee: Wool Research Organization, Canterbury, New Zealand

[21] Appl. No.: 932,661

[22] Filed: Aug. 10, 1978

[30] Foreign Application Priority Data

Aug. 10, 1977 [NZ] New Zealand ..... 184895

[51] Int. Cl.[3] ..... D05C 15/22

[52] U.S. Cl. ..... 112/79 R

[58] Field of Search ..... 112/79 R, 79 A, 285

[56] References Cited

U.S. PATENT DOCUMENTS

| | | | |
|---|---|---|---|
| 2,090,022 | 8/1937 | Baynton et al. | 112/79 R |
| 2,285,021 | 6/1942 | Earp | 112/79 R |
| 2,879,729 | 3/1959 | McCutchen | 112/79 R |
| 2,882,845 | 4/1959 | Hoeselbarth | 112/79 R |

FOREIGN PATENT DOCUMENTS

| | | | |
|---|---|---|---|
| 2341567 | 2/1975 | Fed. Rep. of Germany | 112/79 R |

*Primary Examiner*—Werner H. Schroeder
*Assistant Examiner*—Andrew M. Falik
*Attorney, Agent, or Firm*—Watson, Cole, Grindle & Watson

[57] ABSTRACT

A looper for a tufting machine for producing cut-pile has a base portion, a forward hook-shaped end and a yarn engaging portion around which a loop of yarn is formed extending between the base portion and the forward end, the yarn engaging portion having smooth contours adjacent only the forward end of the looper, the remainder of the length of the yarn engaging portion having a cutting edge formed thereon for effecting the cutting upon cooperation with an independently operable cutting blade of at least one of a series of accumulated loops collected on the yarn engaging portion. Thus, any catching, cutting or breaking of the loop of yarn before being cut by the cutter blade is avoided.

2 Claims, 14 Drawing Figures

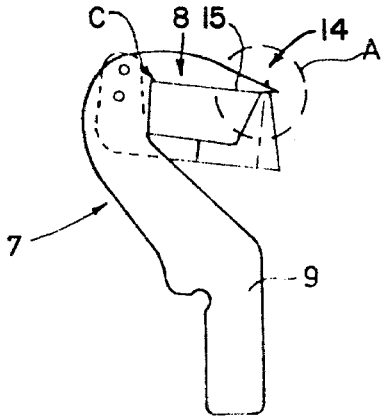
Fig.11
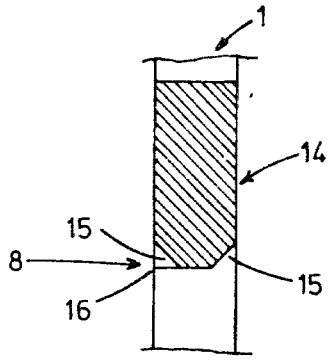
Fig. 11 b
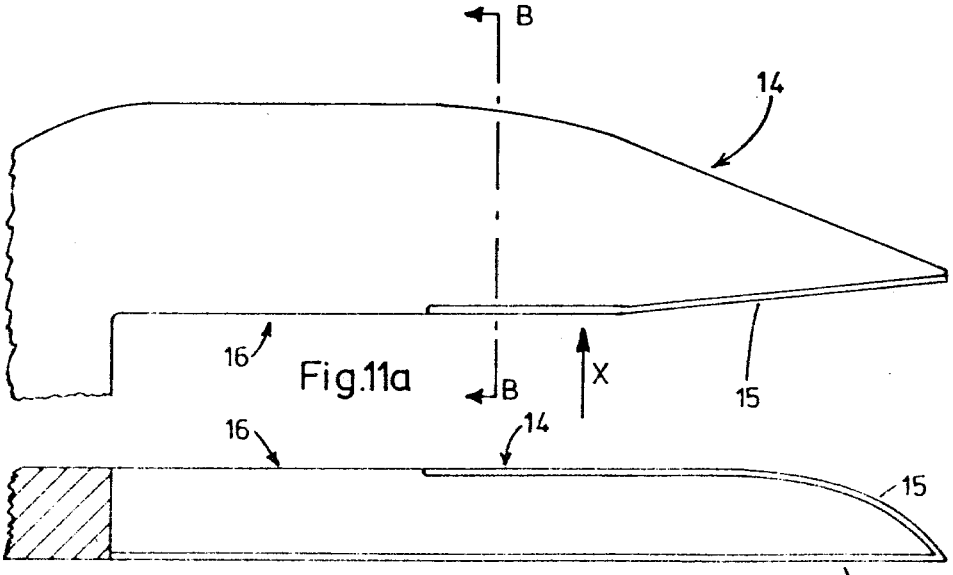
Fig.11a
Fig.11c

CUT PILE LOOPER

FIELD OF THE INVENTION

This invention relates to needles and/or loopers of the type normally used on machines of the type commonly referred to as tufting machines, which needles and/or loopers can also be used on other machines such as sewing machines, stitching machines, stitch bonding machines and the like machines.

DESCRIPTION OF THE PRIOR ART

In known tufting machines yarn is punched through a fabric by a needle through which a yarn is threaded. The yarn when through the fabric is caught and held by a looper positioned on the other side of the fabric which catches and holds the yarn while the needle is withdrawn.

The needles and loopers currently in use on such machines, for example, on a carpet tufting machine, often cause machine stoppages when yarn joints, knots, lumps, yarn irregularities, and impurities such as vegetable matter jam in the eye of the needle and break the yarn. Machine stoppages can also occur with regular or uniform yarns free from slubs, joints, knots, or yarn irregularities if they have a low level of strength and/or extensibility. The needles and loopers currently in use do not give the minimum possible restriction of yarns, joints and lumps during the passage of the yarn through the needle eye nor do they give the minimum possible occurrence of unintentional cutting of the yarn at the looper as, for example, when a gross imperfection in the yarn increases the tension therein as it passes through the needle eye. It is to be appreciated that similar problems occur with both staple and continuous filament yarns.

Accordingly it is an object of the present invention to provide a needle and/or looper which overcomes at least in part the disadvantages stated above which are inherent in known needles and loopers.

Accordingly it is a further object of the present invention to provide a needle usable on tufting, sewing, stitching and the like machines, which needle comprises a suitably shaped elongate blade having at one end thereof a shank and at the other end thereof a point adjacent to which is positioned a needle eye which is shaped and dimensioned to allow unimpeded movement of yarn therethrough particularly when the needle is withdrawn in an upward direction with a loop of yarn held on a looper. This free flow of yarn is preferably achieved by providing a path for the yarn in the blade of the needle so that the yarn can flow through the needle eye with only minimal deflection from a straight line.

Further objects and advantages of the present invention will become apparent from the following description which is given by way of example only.

SUMMARY OF THE INVENTION

According to a first aspect of the present invention there is provided a needle for tufting, sewing, stitching and the like machines, which needle comprises a shaped elongate blade having at one end thereof a shank and at the other end thereof a point adjacent to which is positioned a needle eye, the elongate blade and the point having a path formed therein or thereon above the needle eye and on the point, which path allows unimpeded movement of yarn through the needle eye when the needle is withdrawn in an upward direction.

The path in the elongate blade and the point can be in the form of a channel or recess in the blade which constitutes a path for yarn toward the needle eye and the path in the point can be in the form of a cut-away portion on the side of the point opposite to the channel or recess.

The path is shaped so that the yarn is not unduly deflected from a straight line as it passes through the eye of the needle.

According to a second aspect of the present invention there is provided a looper usable on tufting machines for producing cut-pile, which looper includes a base portion, a forward hook-shape and a yarn engaging portion around which a loop of yarn is formed extending between the base portion and the forward end. The yarn engaging portion has smooth contours adjacent only the forward end of the looper to thereby eliminate a cutting edge normally provided thereat for loopers of this type. The remainder of the length of the yarn engaging portion has a cutting edge formed thereon for effecting the periodic cutting upon cooperation with an independently operable blade of at least one of a series of accumulated loops collected on the yarn engaging portion. Thus, any catching, cutting or breaking of the loop of yarn before being periodically cut by the cutter blade is substantially avoided.

Further aspects of the present invention which should be considered in all its novel aspects will become apparent from the following description which is given by way of example only.

BRIEF DESCRIPTION OF THE DRAWINGS

Examples of the present invention will now be described with reference to the accompanying drawings in which:

FIG. 11 is a side elevation of an alternative construction of looper according to the second aspect of the present invention;

FIG. 11*a* is an enlarged view of the circle A shown in FIG. 11;

FIG. 11*b* is a cross section of the point of the looper on lines B—B shown in FIG. 11*a*; and FIG. 11*c* is a view in the direction of arrow X on the point of the looper shown in FIG. 11*a*.

DESCRIPTION OF THE PREFERRED EMBODIMENTS

Examples of the present invention will now be described with reference to the use thereof on a carpet tufting machine on which cut, loop or cut/loop pile can be formed without imposing any limitation on the application of the invention to other machines or processes as described above.

Carpet tufting is a process in which yarns are stitched into a backing fabric on a carpet tufting machine.

Figure 1:
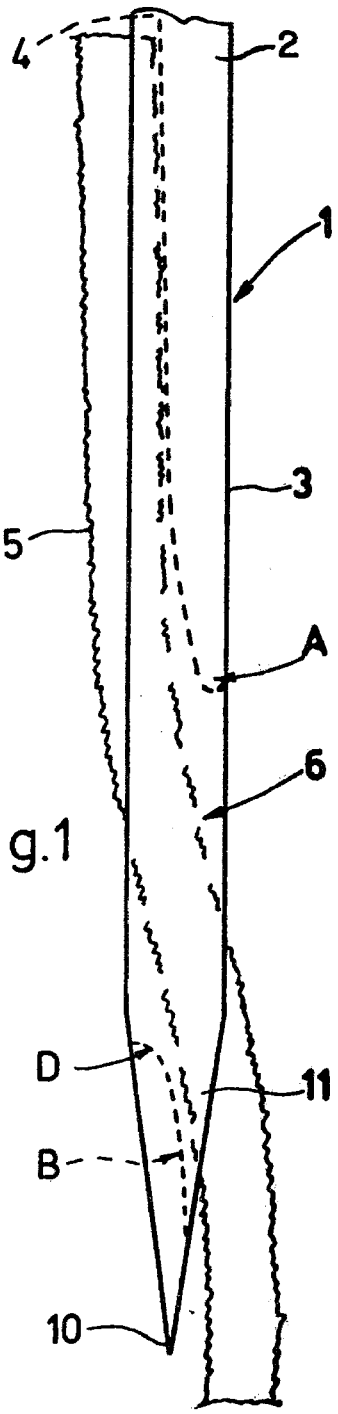
FIG. 1 is a side elevation of a needle according to the first aspect of the present invention.
Figure 2:
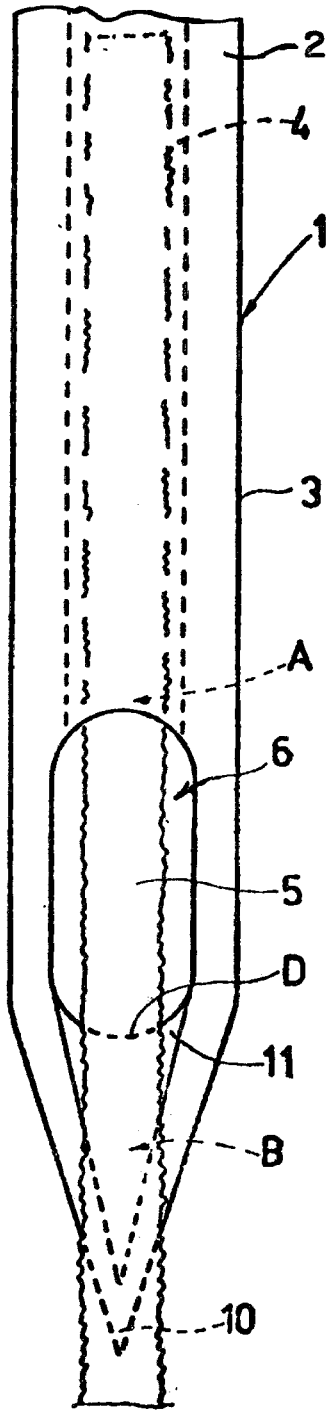
FIG. 2 is a front elevation of the needle shown in FIG. 1.

The needle shown in FIGS. 1 and 2 of the drawings is generally indicated by arrow 1 and has a shank portion 2 (the upper end of which is not shown) which is shaped so that it can be attached in known manner to a needle bar of a tufting machine to which a plurality of needles are incorporated.

The shank 2 is connected to an elongate blade 3 in which a channel or recess 4 (shown dotted) is formed which constitutes a path for yarn 5 toward a needle eye 6. The channel is shaped so that the yarn 5 is not unduly deflected from a straight line in the region of point A. In particular the channel 4 increases in depth to point A and at point A is deeper than at any other point along the length thereof.

The point region 10 of the needle blade 3 also has a part thereof removed thus reducing the thickness in cross section of the point 10 in the region of B. This reduced thickness part B is on the opposite side of the blade 3 to the channel or recess 4, and can be a cut-away portion 11 as shown. The shape of the cut-away portion 11 should be such as to give a minimum of cross sectional thickness of the needle at point B providing adequate mechanical strength and stability is retained.

A further aspect of special significance is the curved shape of the top of the cut-away portion 11 as indicated at point D. There must not be a sharp edge at D at the bottom of the needle eye 6 such as would catch lumps, joints and gross imperfections in the yarn.

Figure 3:
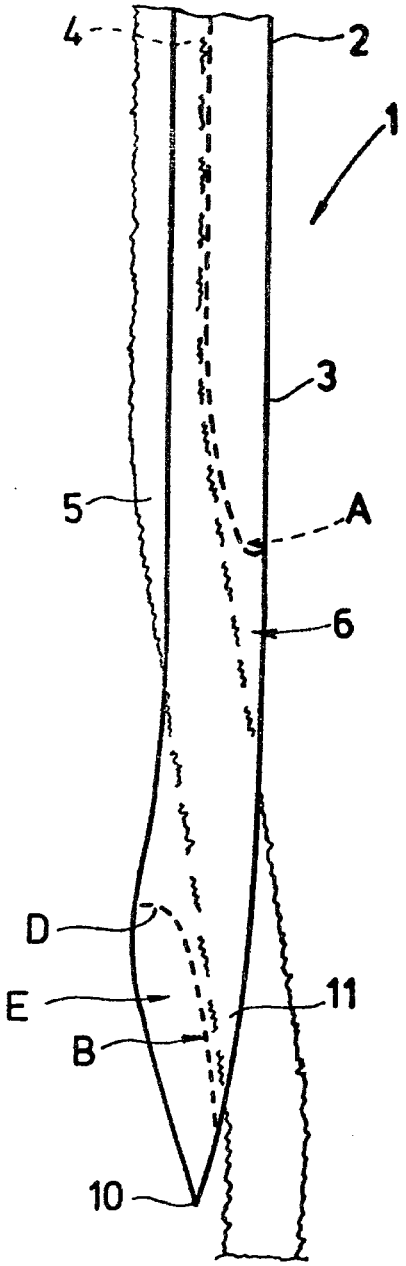
FIG. 3 is a side elevation of a further construction of needle according to the first aspect of the present invention.

The alternative construction of needle shown in FIG. 3 has the parts thereof referenced by the same numerals as the needle shown in FIG. 1. This construction of needle includes on the blade 3 of the needle 1 the provision of a slight lump E on the side of the needle point 10 which is opposite to the cut-away portion 11 to allow the channel to be made deeper in the side of the point and this avoids creating a sharp edge at D.

The recess or channel 4 in the blade 3 of the needle 1 forms together with a cut-away portion 11 a substantially unimpeded path so that movement of the yarn 5 through the needle eye 6 is substantially straight or with a minimum of deflection therein in the region of points A and B.

Figure 4:
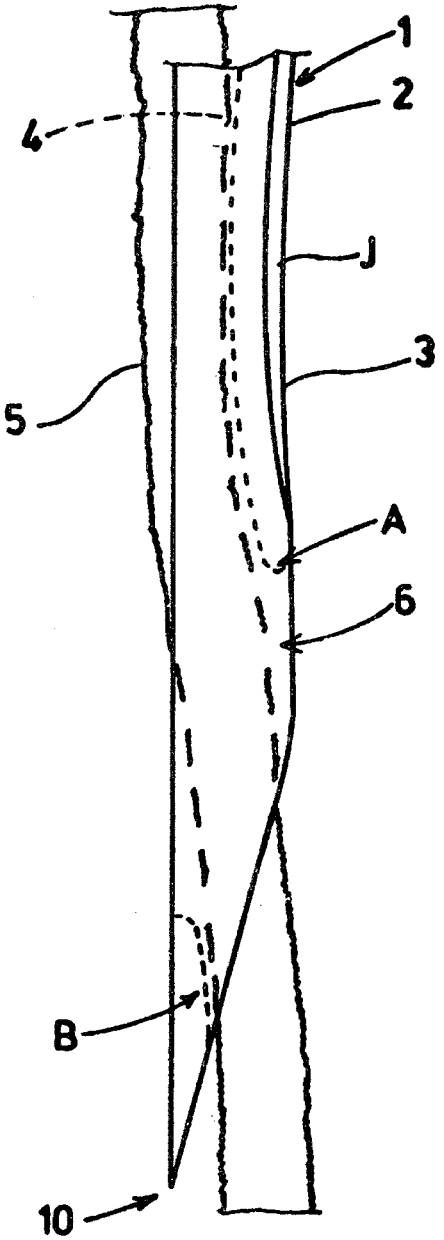
FIG. 4 is a side elevation of a further alternative construction of needle according to the first aspect of the present invention.
Figure 5:
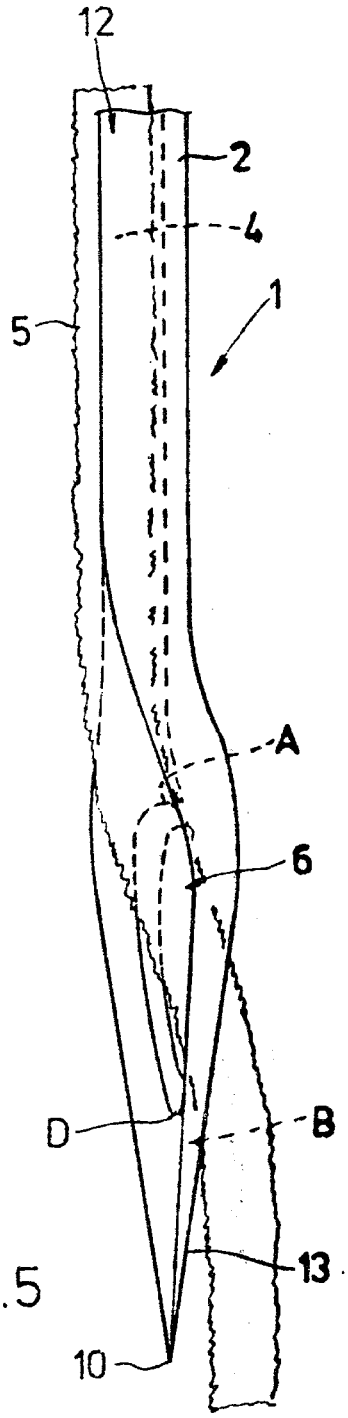
FIG. 5 is a side elevation of a further construction of needle according to the first aspect of the present invention.

The further alternative construction of needle shown in FIG. 4 also has the parts thereof referenced by the same numerals as the needles shown in FIG. 1. This construction of needle has the point 10 formed in an off-center location in order to provide a deeper channel in the region of B. This construction of needle is different to that found in known needles where the point is located off-center in that the off-center point of known needles has been in a plane perpendicular to that of the off-center point shown in FiG. 4.

A feature incorporated in most known needles is the cut-away region of the blade indicated by arrow J in FIG. 4. This feature is generally incorporated in needles according to the present invention, but is not shown in FIGS. 1 to 3.

It has been found during experiments that the provision of a channel above the eye of a needle which deepens just above the eye together with the provision of a groove of maximum depth below the eye leads to a lower failure rate of the said yarn imperfections than has occurred with known constructions of needle.

This is especially true with known needles which have incorporated in the region of A a thread protection lump which in the present invention is removed when deepening the recess or channel 4. In the past such a thread protection lump has been incorporated to lessen the risk of the yarn being cut or broken as the needle moves downwards to be punched through a backing fabric. The applicants have discovered during tests using special photographic techniques that in the event of a yarn imperfection such as a joint or knot occurring the yarn does not need to move through the eye of a needle during the downward stroke thereof and accordingly such thread protection lumps are unnecessary. The yarn in fact need only pass through the eye of the needle during the upward stroke of the needle and the channel above the eye of the needle together with the groove below the eye leads to a lower failure rate of said yarn.

The example of needle shown in FIGS. 5 to 8 shows a typical example of a further construction of needle, the parts of which are referenced by the same numerals as the needles described hereinbefore. In this needle 1 the recess 4 forms part of a known input groove 12 of the needle which is deepened just above the eye 6 in the region of A and to the deepened groove or cut-away portion 11 at point B on the output side 13 on the point region 10 of the needle.

Figure 6:
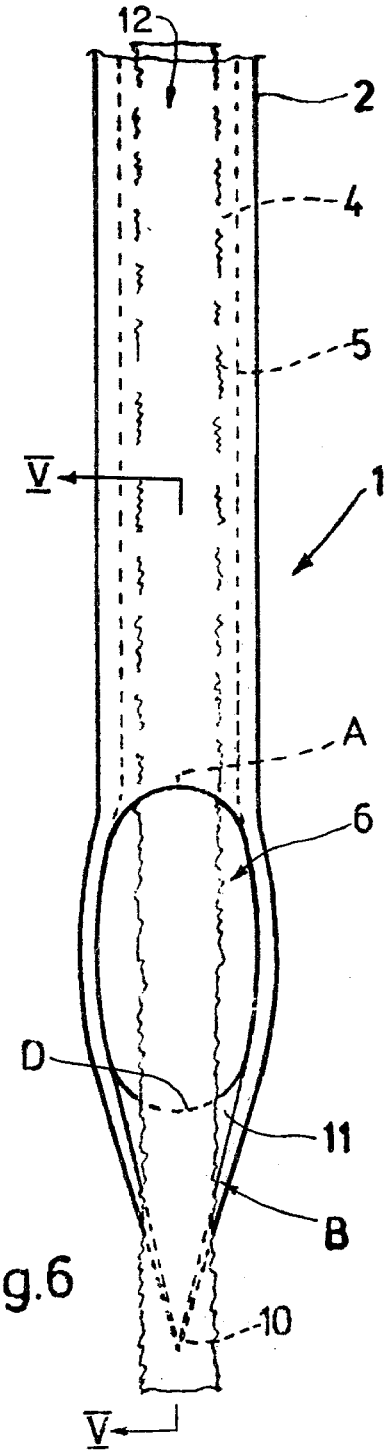
FIG. 6 is a front elevation of the needle shown in FIG. 5.
Figure 7:
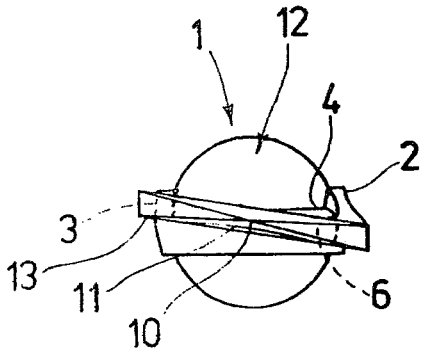
FIG. 7 is an end view of the needle shown in FIGS. 5 and 6.
Figure 8:
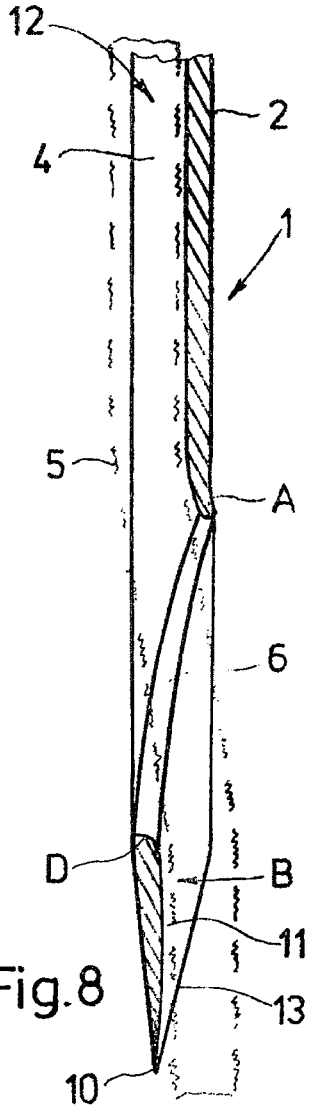
FIG. 8 is a cross section through the needle shown in FIG. 6 as indicated by arrows V—V.

It is to be appreciated that these improvements can be combined in a variety of different sized and shaped needles. Their effect is enhanced if the needle in the region of the eye is bulged adjacent to the eye to allow a wider eye as is shown in FIG. 6. The present invention can be combined with needles having various tip shapes, off-center tips and twisted or biased tips as well as those shown in FIGS. 3 to 8.

The needles can also include other known features not shown in FIGS. 1 to 8, such as the cut-away region J shown in FIG. 4 which gives a cleaner action when a looper contacts the needle.

Figure 9:
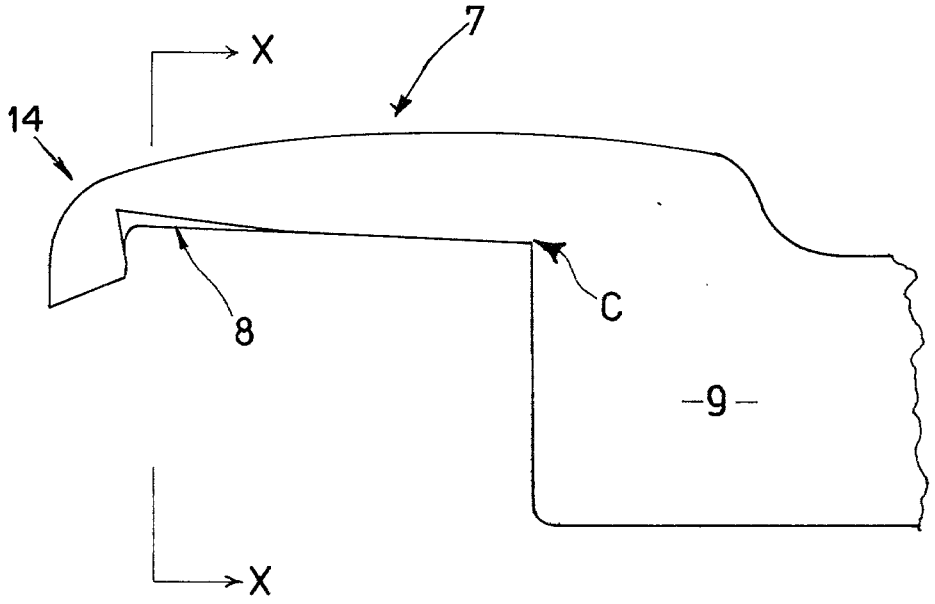
FIG. 9 is a side elevation of part of a looper according to the second aspect of the present invention.
Figure 10:
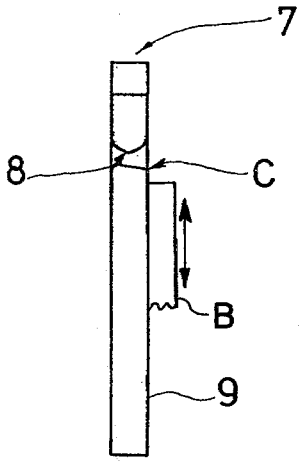
FIG. 10 is a view in the direction of arrows X—X of the looper shown in FIG. 9.

The looper shown in FIGS. 9 and 10 is generally indicated by arrow 7 and has a yarn engaging portion generally indicated by arrow 8 and an attachment or base portion 9 which is used to mount the looper 7 on a looper bar of a tufting machine.

The attachment or base portion 9 can be of any suitable shape and dimensions so that the looper 7 can be attached in known manner to the tufting machine on which the looper 7 is to be used.

The novel aspect of this looper is the yarn engaging portion which is in the region of arrow 8 and which is curved in cross section (see FIG. 10) so that the portion of the looper 7 around which a loop of yarn is formed is curved or is provided with a widened base with all sharp corners or edges thereof removed.

Apart from this rounded yarn engaging portion, the looper 7 shown in FIGS. 9 and 10 is of the type generally used with cut pile tufting machines. In this modified looper 7 only the forward end in the region of arrow 8 of the yarn engaging portion is rounded off. That is, the portion of the cutting edge generally indicated by arrow C of a known looper is rounded off close to the yarn collecting end 14 of the looper 7. The cutting edge is retained in the region of C, that is the portion of the looper 7 closest to the base or attachment portion 9 where it is held by the tufting machine. An independently operable cutter blade B (FIG. 10) is typically provided for cooperation with the cutting edge, in any normal manner, for periodically cutting at least one of a series of accumulated loops on the yarn engaging portion.

An alternative construction of looper is shown in FIG. 11 and in more detail in FIGS. 11*a, b* and *c* and shows a similarly modified looper 7 for use on a cut/-loop pile tufting machine.

The yarn collecting end 14 of the looper has the edges 15 of the yarn engaging portion 8 thereof rounded off so that as loops of yarn are caught in the region of arrow 8 of the engaging portion they do not catch and cut or break the yarn.

It is to be appreciated that a plurality of loops are gathered at a time on each looper if cut pile or cut/loop pile carpet is being formed and if the loops are to be cut periodically a cutter blade 17 acts in the region of 16 (FIGS. 11*a, b* and *c*) to cut one of the accumulated loops.

In use a plurality of the needles 1 according to one of the examples shown in FIGS. 1 to 8 and the loopers 7 according to one of the examples shown in FIGS. 9 to 11 are incorporated into a carpet tufting machine so that in operation each needle 1 with the yarn 5 passing through the needle eye 6 thereof is punched through a backing fabric beneath which a corresponding looper 7 catches and holds a loop of yarn as the needle 1 is withdrawn. The shaped passage in the needle 1 as it is withdrawn upwards ensures free movement of the yarn 5 as it passes along the channel or recess 4 to the needle eye 6. As the yarn 5 is allowed to move so as to be deviated or unimpeded as little as possible as it passes through the needle eye 6 in the regions A and B of the needle 1 the yarn 5 runs more smoothly therethrough particularly when joints and lumps occur.

As a straighter flow of yarn occurs when the yarn 5 is caught and held by the looper 7 when and if unintentional increases in tension occur the rounded off portion 8 which is engaged with the loop in the yarn 5 reduces the tendency of the looper 7 to cut or break the yarn 5.

Thus by the replacement of conventional needles and/or looper with needles and loopers according to the present invention a substantial reduction in the breakage of yarns due to the jamming, sticking or breaking associated with imperfections and general yarn weakness therein is gained.

A corollary to this advantage is that the use of the needles and/or loopers according to the present invention enables a yarn of higher linear density to be tufted at a gauge other than is possible with known needles and loopers. This is because the larger joints and lumps associated with a thicker yarn are less difficult to pass through the eye of the needle according to the present invention.

Particular examples of the present invention have been described by way of example and it is envisaged that modifications to and variations of the present invention can take place without departing from the scope of the appended claims.

What I do claim and desire to obtain by Letters Patent of the United States of America is:

1. In a tufting machine for producing cut-pile, the machine including a looper and an independently operable cutting blade movable relative thereto for effecting a cutting of yarn loops, the looper having a base portion, a forward hook-shaped end and a yarn engaging portion around which a loop of yarn is formed extending between said base portion and said forward end, said yarn engaging portion having a cutting edge formed along the entire length thereof so that the cutting blade can periodically cooperate therewith to cut at least one of a series of accumulated loops collected on said yarn engaging portion, the improvement wherein said yarn engaging portion has smooth contours adjacent only said forward end of the looper to thereby eliminate said cutting edge thereat, the remainder of said length of said yarn engaging position having said cutting edge formed thereon for effecting the cutting upon the cooperation with said blade of said at least one of the series of accumulated loops, whereby any catching, cutting or breaking of the loop of yarn before being periodically cut by the cutter blade is substantially avoided.

2. The looper according to claim 1, wherein said yarn engaging portion adjacent said forward end of the looper is curved.

* * * * *